US007850005B2

(12) United States Patent
Bras et al.

(10) Patent No.: US 7,850,005 B2
(45) Date of Patent: Dec. 14, 2010

(54) SEPARATION CONTAINER WITH INTERDISPOSED MEMBRANE

(75) Inventors: Michel Bras, Laguiole (FR); Laurence Paris, Commentry (FR)

(73) Assignees: Interpharm Development, Renens (CH); Michel Brevet, Languiole (FR)

( * ) Notice: Subject to any disclaimer, the term of this patent is extended or adjusted under 35 U.S.C. 154(b) by 314 days.

(21) Appl. No.: 11/828,157

(22) Filed: Jul. 25, 2007

(65) Prior Publication Data

US 2008/0017530 A1 Jan. 24, 2008

Related U.S. Application Data

(63) Continuation-in-part of application No. 10/482,856, filed as application No. PCT/FR02/02360 on Jul. 5, 2002, now abandoned.

(30) Foreign Application Priority Data

Jul. 5, 2001 (FR) ..... 01 08913

(51) Int. Cl.
*B65D 25/08* (2006.01)

(52) U.S. Cl. ..... 206/219

(58) Field of Classification Search ..... 206/219–222; 215/DIG. 8; 220/359.1–359.5; 366/602
See application file for complete search history.

(56) References Cited

U.S. PATENT DOCUMENTS

| | | | | |
|---|---|---|---|---|
| 593,129 | A | 11/1897 | Shultes | |
| 1,106,263 | A | 8/1914 | Weathersby | |
| 2,487,236 | A * | 11/1949 | Greenberg | 206/220 |
| 3,077,262 | A | 2/1963 | Gaste | |
| 3,537,577 | A * | 11/1970 | Goupil | 206/222 |
| 3,695,478 | A | 10/1972 | Sie et al. | |
| 3,730,337 | A | 5/1973 | White | |
| 3,756,389 | A * | 9/1973 | Firth | 206/219 |
| 4,182,447 | A * | 1/1980 | Kay | 206/220 |
| 4,362,242 | A * | 12/1982 | Cheetham | 206/219 |
| 4,776,455 | A | 10/1988 | Anderson et al. | |
| 4,836,370 | A | 6/1989 | Bosshard | |
| 4,856,651 | A | 8/1989 | Francis, Jr. | |
| 4,863,017 | A * | 9/1989 | Vlock | 206/219 |
| 5,394,980 | A * | 3/1995 | Tsai | 206/219 |
| 5,476,175 | A | 12/1995 | Jaszai | |

FOREIGN PATENT DOCUMENTS

| | | |
|---|---|---|
| EP | 0 173 547 | 3/1986 |
| EP | 0 232 814 | 8/1987 |
| EP | 0 461 693 A | 12/1991 |
| FR | 2 507 573 | 12/1982 |
| FR | 2 633 250 | 12/1989 |
| FR | 2 783 804 | 3/2000 |
| GB | 1 192 817 | 5/1970 |

* cited by examiner

*Primary Examiner*—Byron P Gehman
(74) *Attorney, Agent, or Firm*—Akerman Senterfitt; Peter A. Chiabotti

(57) ABSTRACT

A separation container is provided that includes a first container for storing a first substance, a second container for storing a second substance, and a frame structurally located at a periphery of the first cavity and the second cavity that supports an elastic membrane interdisposed between the first cavity and the second cavity to provide a tension seal. The elastic membrane can be completely retracted to allow the first substance to combine with the second substance responsive to a force applied to the separation container.

23 Claims, 11 Drawing Sheets

SEPARATION CONTAINER WITH INTERDISPOSED MEMBRANE

CROSS REFERENCE TO RELATED APPLICATION

This application is a continuation-in-part claiming priority to currently U.S. patent application Ser. No. 10/482,856 filed on Jan. 5, 2004 now abandoned, with the title SEPARATION AND/OR CLOSURE WALL FOR A CONTAINER AND METHODS FOR ASSEMBLING CONTAINERS USING SUCH A WALL, which is a §371 National Phase Application of PCT/FR2002/002360, the entirety of both of which are herein incorporated by reference.

FIELD OF THE INVENTION

The present invention relates to packaging, and more specifically, to a packaging of separate substances in a same container and a mixing of the substances in the container at a time of their utilization by an action applied to the packaging.

BACKGROUND

Product developments in chemical, pharmaceutical, dietetic, cosmetic, and food industries has led to the creation of new packages consisting of several contents. The contents of the packages are not to be mixed until the moment of their utilization. The contents can be packaged in separate containers to prevent the contents from interacting or mixing prior to their determined use. A partitioning between the containers can further ensure separate storage of the contents before their utilization.

In the case of pharmaceutical products it is beneficial to keep substances, such as chemicals, separated prior to use to prevent physicochemical reactions caused by mixing of the substances. Similarly, in the case of food products, such as injectable pastry products, it is beneficial to keep the food substance separated prior to use to preserve the distinction of aromas and taste. Also, in the case of industrial supplies, such as cream and gels or in the field of manufacture of certain hardeners of fast-acting glues, it is beneficial to keep the substances separate prior to use.

In the case of food products, in order to avoid mixing before consumption, the majority of multi-layer food products present on the market today, use a concept that is based on layering, resulting from the difference of viscosity and density between each product. However, layering does not guarantee that mixing will not occur, notably during transportation which, due to poorly damped shocks, may cause instantaneous and unintended mixing of the two substances, thus, making the product difficult to market.

One solution to premature mixing of substances is based on a packaging concept called double packaging. Such a device is described in French Patents 2633250 and 2783804, which propose a packaging made with a homogeneous and tight block superimposing two compartments, one of the containers having an operculated orifice on its outside surface which is pierced using an external item, outside of the packaging, the said item of perforation item also serving to perforate the separation between the two compartments in order to mix the two contents.

However, one disadvantage of this device is that the material used as a partition wall between the two compartments upon removal does not completely expose the two superimposed compartments. As a result, the substances within each compartment may not be adequately mixed. Furthermore, the devices may not sufficiently protect the material or the partition wall used to separate the different compartments, for example, during routine handling of the device.

Another solution of the prior art described in French Patent 2507573 consists of a two compartmental containers. The two compartments are separated by a partition wall that can be perforated by a perforating device placed inside the container. One disadvantage of this device is that it is handled with the aid of a straw, which provides the perforation of the partition wall between the two compartments and the mixing of the contents of the two compartments. The partition wall between the two compartments comprises aluminum sheets which do not permit a complete opening with the straw. In such cases, the content flow from the upper compartment may be incomplete and not allow proper mixing.

Another device of the prior art described in European Patent 0232814 describes a two compartment container, the cover of which has a perforating device. The deformation of the container permits perforation of the partition and mixing of two substances stored separately in each of the two compartments. However, the container is opened from the top to tear a separation wall, an action which does not always result in the removal the torn separation wall of the container.

Another device described in European Patent 0173547 proposes a container composed of three parts namely a first principal container filled with a first substance, a second container located in the first compartment and closing it, and being supported on the edge of its opening, and a cover assuring sealing of the second container and perforation of the bottom of the second compartment. However, the two compartment system has one disadvantage of perforating the bottom of a compartment and not a cover, which requires additional action from the user.

U.S. Pat. No. 3,695,478 and European Patent 0461693 describe a stopper for cartridges which is subsequently clipped on a needle of a hypodermic syringe. A rubber or elastomer stopper is employed to allow for closure after the stopper is pierced, thus allowing for reuse of the stopper. However, this type of stopper does not adequately permit a complete and definitive opening of the cartridge.

Another device described in British Patent 1,192817 proposes a packaging capsule for pre-dosed dental amalgam, which has two compartments, containing two substances, which are intended to be mixed only at a time of the use, and which are separated by a membrane. The membrane opens when the capsule is accelerated above a threshold value, for example, when the capsule is placed in an amalgamator. For example, the amalgamator can spin the capsule around to accelerate the substances and push them through the membrane. However, the membrane, which has a predetermined form generally only stays open during the acceleration and closes afterward. In such regard, the opening does not completely remain open after exposure of some of the substances.

U.S. Pat. No. 4,182,447 discloses a method of shaking a capsule to induce a rupture of a membrane separating the substances. A plunger placed in one of the compartments that is free to move in the compartment causes a rupture of the membrane responsive to the shaking movement.

U.S. Pat. No. 4,863,017 describes a double packaging for dental amalgam. IA membrane having a shape of a funnel with a small hole at its lower part, can retain mercury without flow due to the physical properties of the membrane. Under a centrifuge force, the mercury pushes through the small hole to be mixed with the second compound packed in this double packaging. The opening remains opened during the centrifugal process.

U.S. Pat. Nos. 4,776,455, 3,730,337, and 3,077,262 disclose an inner packaged container, such as a sachet, where two folds of the sachet are sealed in the middle of the whole package. This provides two compartments but without a partition wall. A pressure on one compartment can break the sealing between the two compartments to induce a mixing of the substances within the two compartments.

U.S. Pat. No. 4,856,651 describes a thermal pack containing an inside sachet. In each compartment there is a product which is put in contact with the other only by squeezing the pouch manually.

U.S. Pat. No. 5,476,175 describes a wrapping pouch having two compartments, one compartment contains an object to be wrapped, the second compartments contains a gas. The second compartment provides a protective surrounding to the first compartment. The partitioning between the two compartments remains intact to protect the object. The partitioning is not intended to be broken sand helps avoid shocks during transportation.

SUMMARY OF THE INVENTION

In one embodiment a separation container is provided that comprises a first container having a first cavity suitable for storing a first substance, a second container having a second cavity suitable for storing a second substance, and a frame structurally located at a periphery of the first cavity and the second cavity that supports an elastic membrane interdisposed between the first cavity and the second cavity and providing a tension seal to separate the first substance from the second substance. The elastic membrane can be stretched across at least one of the periphery of the first cavity and the second cavity and held in place by the frame to provide the tension seal. The elastic membrane can be completely retracted to allow the first substance to combine with the second substance responsive to a force applied to at least one of the first container and the second container that causes the frame to rupture the tension seal along the periphery. The force can be a pushing or rotational force applied to the separation container.

In a second embodiment, a frame suitable for partitioning a first container and a second container is provided. The frame can include at least one aperture located along a periphery of the frame, at least one clip inserted in the at least one aperture to produce a clipping system that firmly holds at least one rim of the first container or the second container, and an elastic membrane stretched across the frame and held in place by clipping or glue to produce a tension seal that separates a first substance in the first container from a second substance in the second container. The elastic membrane can be completely retracted to allow the first substance in the first container to combine with the second substance of the second container responsive to a force applied to at least one of the first container and the second container that causes the frame to rupture the tension seal along the periphery.

In a third embodiment, a separation container is provided. The separation container can include a first container having a first cavity suitable for storing a first substance, a second container having a second cavity suitable for storing a second substance, a frame structurally formed around a periphery of the first cavity and the second cavity, and an elastic membrane interdisposed between the first cavity and the second cavity for providing a tension seal to separate the first substance from the second substance. The frame can have an aperture for receiving a first rim of the first container and a second rim of the second container. The elastic membrane can be stretched across the periphery of the first cavity and the second cavity and held in place by the frame to provide the tension seal. The first rim can have an edge surface with lugs that are located internal to the aperture of the frame. The lugs rub across the elastic membrane responsive to a rotational movement of the first container relative to the second container. The rotational force causes the elastic membrane to rupture the tension seal around the periphery to combine the first substance with the second substance.

BRIEF DESCRIPTION OF THE DRAWINGS

The features of the system, which are believed to be novel, are set forth with particularity in the appended claims. The embodiments herein, can be understood by reference to the following description, taken in conjunction with the accompanying drawings, in the several figures of which like reference numerals identify like elements, and in which:

DETAILED DESCRIPTION OF THE INVENTION

Figure 1:
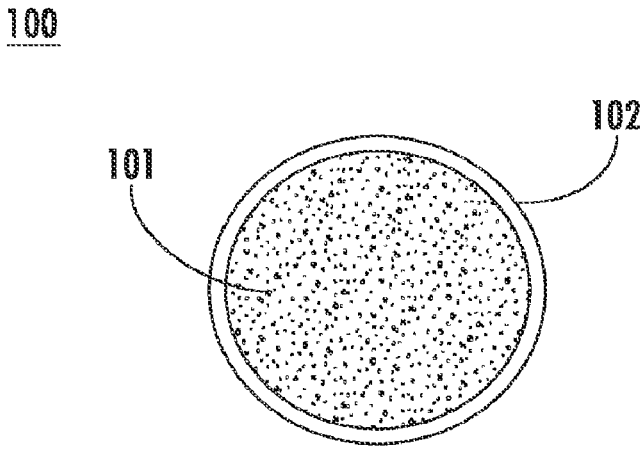
FIG. 1 is a diagram of a membrane in accordance with the embodiments of the invention.

While the specification concludes with claims defining the features of the embodiments of the invention that are regarded as novel, it is believed that the method, system, and other embodiments will be better understood from a consideration of the following description in conjunction with the drawing figures, in which like reference numerals are carried forward.

As required, detailed embodiments of the present method and system are disclosed herein. However, it is to be understood that the disclosed embodiments are merely exemplary, which can be embodied in various forms. Therefore, specific structural and functional details disclosed herein are not to be interpreted as limiting, but merely as a basis for the claims and as a representative basis for teaching one skilled in the art to variously employ the embodiments of the present invention in virtually any appropriately detailed structure. Further, the terms and phrases used herein are not intended to be limiting but rather to provide an understandable description of the embodiment herein.

The term "partition wall" can be defined as an element which fixed inside a container permits to obtain several distinct cavities called units or storage compartments. The term "membrane" can be defined as a flexible partition made with an elastic material. The term "complete retraction" or "total retraction" can be defined as a shrinking or retraction of a membrane. The term "bursting" can be defined as a complete disappearance of a membrane from the place the membrane occupied when providing separation. The term "flexible" can be defined as elastic deformations of a material or of a membrane.

Referring to FIG. 1, a framed membrane 100 is shown. The framed membrane includes a membrane 101 and a frame 102. The membrane 101 can be an elastic material such as a polymer, latex, or rubber. The frame 102 can be glued or affixed to the elastic membrane 101 to provide a tension seal. The elastic material can also be of a natural origin. One type of rubber is 1,4-polisopropene with a molecular weigh that varies from 100,000 to 1,000,000. The polyisopropene can be synthesized to show the same elastic properties as the natural rubber. One difference is that the synthetic product does not give, at the medical level, allergies induced by residual proteins.

Other elastic polymers like silicones can also be used for the membrane material. Depending on the monomer utilized during the polymerization reaction, dimethylsiloxane and/or methylvinylsiloxane, or other different kinds of silicones can be obtained for the membrane 101 which are characterized, among other things, by their elongation modulus. Other polymers of the butadiene family can be similarly used, such as neoprene or Duraprene®. These are polymers of chloropropene with a molecular weigh that can vary from 100,000 to 300,000. The same material used for "latex free" surgical gloves, can be used as the membrane 101, for example "Nitrile". Nitrile is a combination of 3 monomers: acrylonitrile, butadiene and a carboxylic acid. The combination of these 3 ingredients produces a rubber-like elastic material after vulcanization. Moreover, other substances can be added to the membrane manufacturing process to strengthen the membrane.

The framed membrane 100 can be inserted in a container to provide a partition wall for creating at least two distinct compartments. As noted above, the elastic membrane 101 comprises materials that allow for a complete retraction of the elastic membrane responsive to a stretch, tear, or piercing. The partition wall, being fixed under tension between the two compartments, ensures a separated storage of each substance. Upon receiving a user applied action, the partition wall bursts ad allows for the mixing of substances in the separate containers. Notably, as a result of the composition of the materials used, the elastic membrane can totally retract around the periphery of the container responsive to the user applied action.

Figure 2:
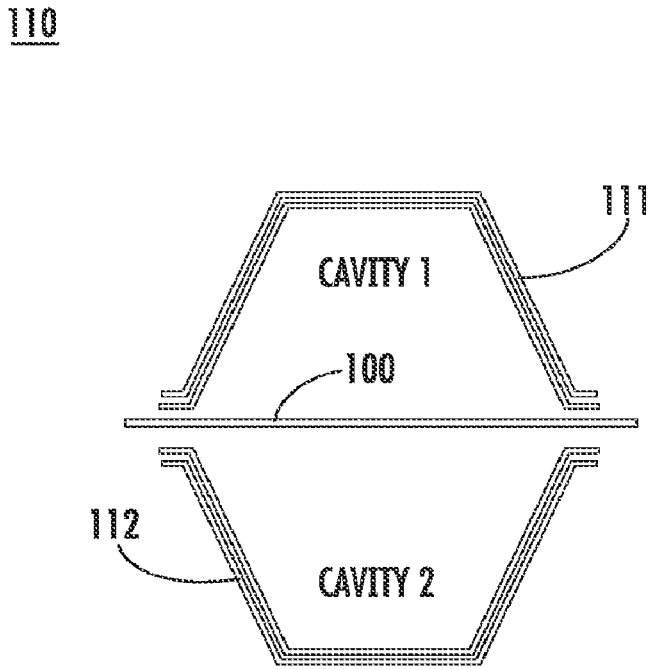
FIG. 2 depicts a separation container in accordance with the embodiments of the invention.

FIG. 2 depicts a separation container 110 in accordance with one embodiment of the invention. The separation container 110 can include a first container 111 having a first cavity suitable for storing a first substance, a second container 112 having a second cavity suitable for storing a second substance, and the framed membrane 100 structurally located at a periphery of the first cavity and the second cavity that supports the elastic membrane interdisposed between the first cavity and the second cavity and providing a tension seal to separate the first substance from the second substance.

The elastic membrane 101 (See FIG. 1) is stretched across at least one of the periphery of the first cavity and the second cavity and held in place by the frame 102 to provide the tension seal. The elastic membrane can be retracted to allow the first substance to combine with the second substance responsive to a force applied to at least one of the first container and the second container that causes the frame to rupture the tension seal along the periphery. As one example, a user can push together the first container 111 and the second container 112 to cause the frame 102 to rupture the membrane 101. As another example, the user can twist the first container 111 relative to the second container 112 while simultaneously applying a compressing (e.g. pushing together) action to cause the frame 102 to rupture the membrane 101. As another example, the user can apply a squeezing action to either the first container 111 or the second container 112 to cause the frame 102 to rupture the membrane 101. Notably, a unique construction of the frame 101 allows for a predetermined type of rupture based on the user applied action. Furthermore, the composition of the elastic membrane 101 allows for a complete shearing, tearing, or ripping of the elastic membrane responsive to the force and due to the construction of the frame.

Briefly, the framed membrane 100 uses elastic materials, which when inserted inside the separation container 110 under tension, as a flexible membrane, burst under an applied user action, resulting in a stretch, piercing or pinching at a time of the utilization of the separation container. The elastic membrane 101 is constructed so as to completely open within the frame 102 in response to the applied user action. In particular, the elastic membrane can be totally retracted into the frame, or around the periphery of the frame, to expose a complete opening between the two containers.

This separation container 110 can be used for various types of packaging to provide a mixing of one or more separated substances responsive to a user applied action, such as a twisting, pushing, or squeezing action. As one example, the first container 111 can contain a dry foods product, such as cereal, and the second container 112 can contain a liquid, such as milk. Notably, other contents, substances, or chemicals are herein contemplated for mixing. The separation container 110 can keep the contents separate until the user elects to mix the contents at a particular time, for example by applying a twisting, pushing, or squeezing force to the separation container 110. Moreover, due to the construction of the separation container 110, the framed membrane 100 will be sufficiently hidden such that the user only sees one package. Furthermore, the separation container 110 upon mixing the contents effectively converts from a two container package to a single container package. That is, the elastic membrane retracts completely so as to combine the first cavity with the second cavity into a single cavity by completely exposing the opening of the first container 111 to the opening of the second container 112. By completely exposing the previously separated containers, the substances can be completely and properly mixed.

At the molecular level, the composition of the elastic membrane 101 is analogous to a net having a plurality of meshes. The meshes may be layered on top of one another with an alignment of molecules that allow for a point source tear. Under tension these meshes are stretched and when one mesh is broken, either by piercing or by extreme stretching, all adjoining meshes tear in a similar manner resulting in a complete destruction of the net. Accordingly, the elastic membrane 101 assures a strong resistance to any kind of broad external pressures, for example, those due to some non-piercing and non-cutting substances. The elastic membrane is constructed to burst responsive to particular actions such as a piercing or applied tension to release products separated by the elastic membrane.

As one example, the elastic membrane can comprise rubber which shows a very good elasticity with some ingredients. The rubber when combined with a chloropropene polymer can provide chemical stability without overly compromising elasticity. Such a combination of materials can be obtained by placing different sheets of elastic material together during a manufacturing process. In order to achieve a complete opening of the elastic membrane in response to an applied force, the thickness of the elastic membrane, and the stress applied to the elastic membrane is selected specific to the type of force applied and the construction of the frame 102. For example, the thickness and size can be selected as a function of the desired opening between the first container 111 and the second container 112, and the composition of materials.

To permit a desired rupture pattern of the elastic membrane, or more specifically a destructuring of the polymeric net, mono-layer and multi-directional meshes are generated within the elastic membrane. Above some thickness, it is impossible to obtain a mono-layer and multi-directional system by conventional stretching means. The net formed becomes tri-dimensional which allows for a structured breaking of the net mesh. In such regard, the elastic membrane can destruct in a predetermined manner based on the type of force applied to the frame 102. For example, the elastic membrane can be designed to completely rupture in one manner by a rotational force, or in another manner by a pushing force, for example along a perforated edge, or along a periphery of the frame 102.

The tension of the elastic membrane 101 is a function of the thickness. The elastic membrane can exhibit a maximal elongation modulus between 50 and 1500, preferentially between 100 and 1000. The maximal elongation modulus can be measured in centimeters and expressed in percentage. In one configuration, the elastic membrane 101 can comprise elastic films having a thickness of 10 μm, a length of 3 cm and width of 1.5 cm. The elongation modulus can be vary from 233 for "nitrile" to 1100 for silicones, up through 266 for Duraprene® membranes and 350 for latex membranes. In "Nitrile" an elongation of 166% permits the bursting of the membrane while ensuring a good elasticity of the membrane. This elongation also provides good absorption of shocks. In practice, the frame 102 can place the elastic membrane under tension by stretching it between 70% and 100% of the maximal elongation modulus value. In these conditions, the retraction of the membrane will be complete during rupture thus allowing the content in the first container 111 to completely mix with the contents in the second container 112.

Figure 3:
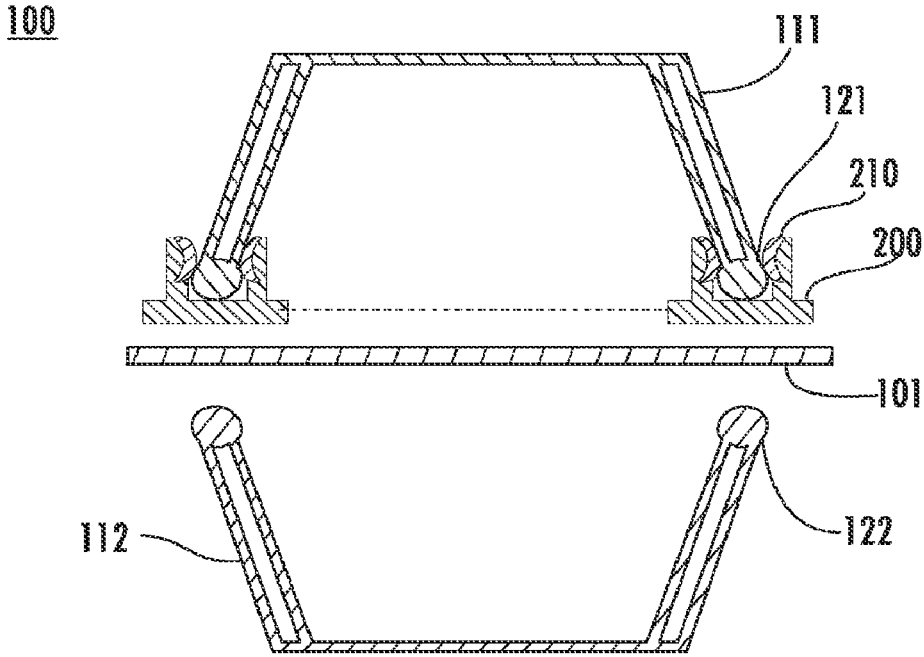
FIG. 3 depicts a frame having a top aperture of a separation container in accordance with the embodiments of the invention.

FIG. 3 depicts a frame having an aperture 200 in accordance one embodiment of the invention. As illustrated, the frame includes at least one clip 210 in the aperture 200 of the frame that receives a rim 121 of the first container 111. The elastic membrane 101 can be glued or fixed to the bottom of the aperture 200 to provide the tension seal. It should also be noted that the aperture 200 can be attached to the framed membrane 100.

Figure 4:
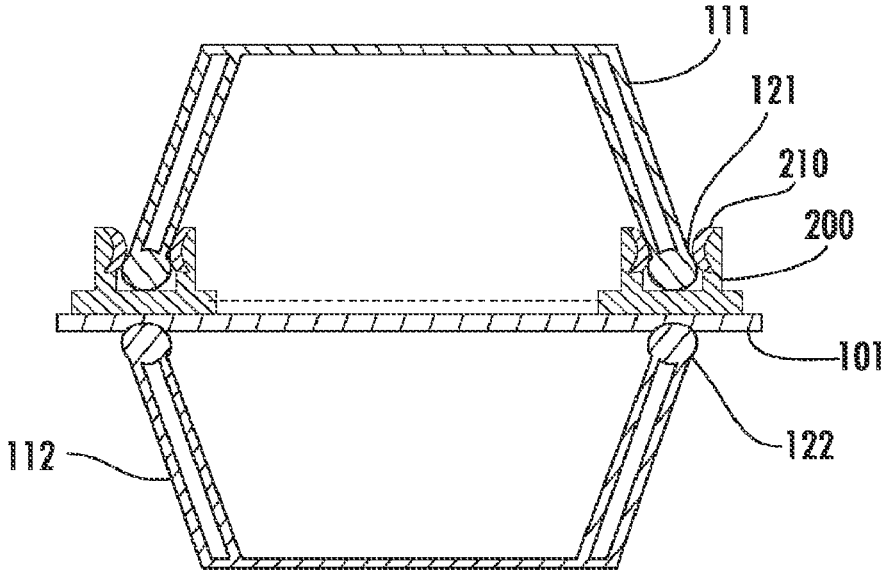
FIG. 4 depicts the separation container of FIG. 3 in a sealed configuration in accordance with the embodiments of the invention.

FIG. 4 depicts the separation container of FIG. 3 in a sealed configuration in accordance with one embodiment of the invention. As illustrated, the rim 121 of the first container 111 is inserted into the aperture of the frame 200. The aperture 200 is affixed to the framed membrane 191, which is also affixed to the second container 112.

Figure 5:
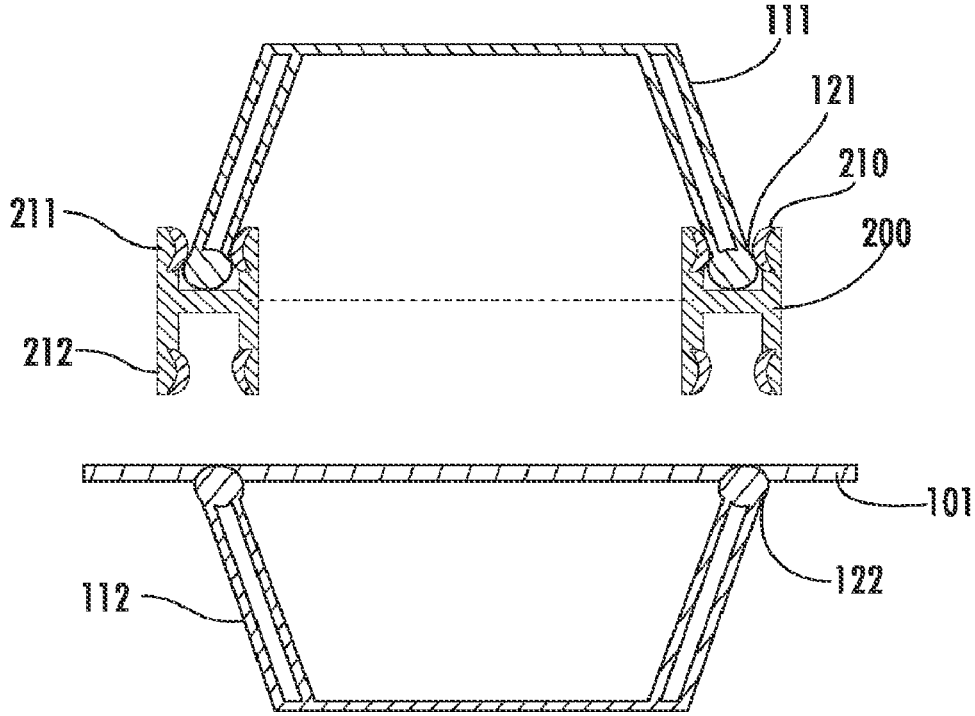
FIG. 5 depicts a frame having a top aperture and a bottom aperture of a separation container in accordance with the embodiments of the invention.

In another embodiment, FIG. 5 depicts a frame 201 having a top aperture 211 and a bottom aperture 212 of a separation container in accordance with one embodiment of the invention. The second aperture 212 provides for a stabilization of the first container 111 and the second container 112 responsive to a force applied to the separation container. As illustrated, the frame 201 includes at least one clip 210 in the top aperture 211 of the frame 201 that receives a rim 121 of the first container 111. The frame 201 also includes another clip in the bottom aperture 212 that receives a rim 122 of the second container 112 to stabilize the separation during an applying of the force.

Figure 6:
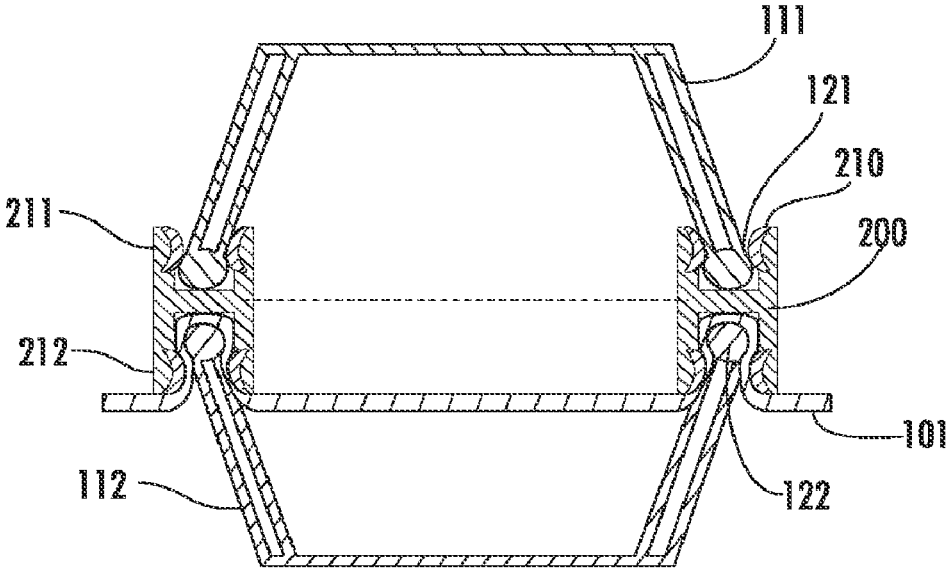
FIG. 6 depicts the separation container of FIG. 5 in a sealed configuration in accordance with the embodiments of the invention.

FIG. 6 depicts the separation container of FIG. 5 in a sealed configuration in accordance with one embodiment of the invention. The elastic membrane 101 is interdisposed onto the rim 122 and held in place by the clipping system to provide the tension seal.

Figure 7:
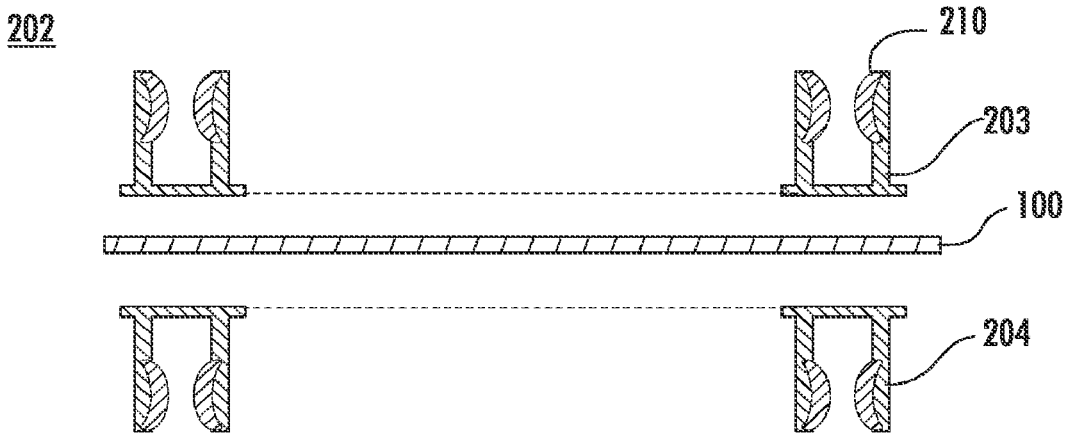
FIG. 7 depicts a clipping system of the frame of FIG. 5 in accordance with the embodiments of the invention.

FIG. 7 depicts another frame 203 having a top aperture 203 affixed to a top portion of the framed membrane 100 and a bottom aperture 204 affixed to a bottom portion of the framed membrane 100. Recall, the framed membrane includes the frame 102 and the membrane 101. Each aperture can include one or more clips 210 of a clipping system to hold a rim of a container.

Figure 8:
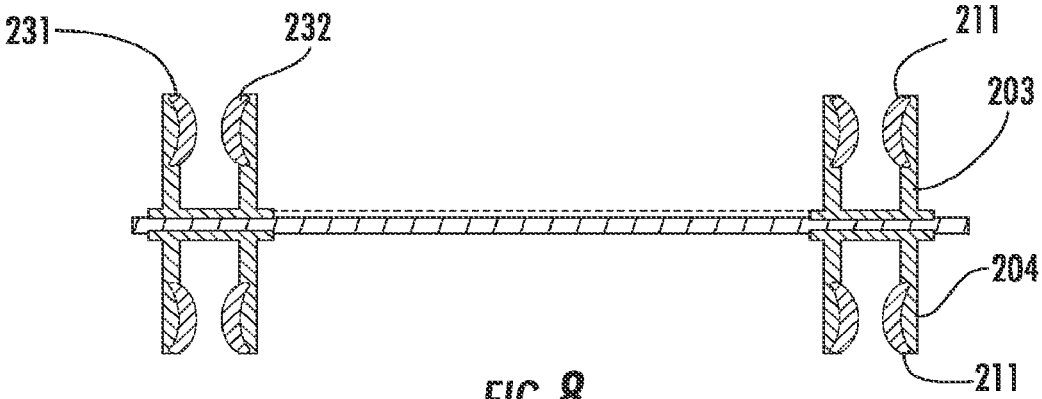
FIG. 8 depicts an assembly of the frame of FIG. 7 in accordance with the embodiments of the invention.

FIG. 8 depicts an assembly of the frame of FIG. 7. The top aperture 203 can fully encircle the first container, and the bottom aperture 204 can fully encircle the bottom container. That is, the apertures can follow the perimeter of the membrane to provide a fully sealed container. A double clipping device 211 comprising the top aperture 203 and the bottom aperture 204 can have an outside strip 231 that firmly holds the elastic membrane (not shown) when inserted in the aperture 204 and an inside strip 232 that allows stretching and elongation of the elastic membrane along the rim 121 of the first container 111 to cause the elastic membrane to rupture responsive to an applied force. The elastic membrane 100, or the framed membrane 100 (not shown) can be glued or thermo sealed under tension, on one part of a rigid frame 231. A second part 232 of the rigid frame can be sealed or clipped on the other side of the membrane. In this case the tension of the elastic membrane is realized "in process" during the process of the package filling.

Figure 9:
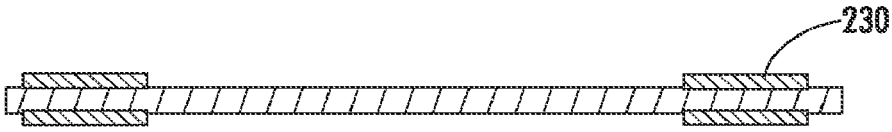
FIG. 9 depicts a compressible material on a frame in accordance with the embodiments of the invention.

FIG. 9 depicts a compressible material 230 as part of a frame in accordance with one embodiment of the invention. The compressible material 230 can be foam or another spongy material that compresses responsive to an applied force. The compressible material 230 can be placed along the periphery of the framed membrane 100 so as to receive a rim of a container.

Figure 10:
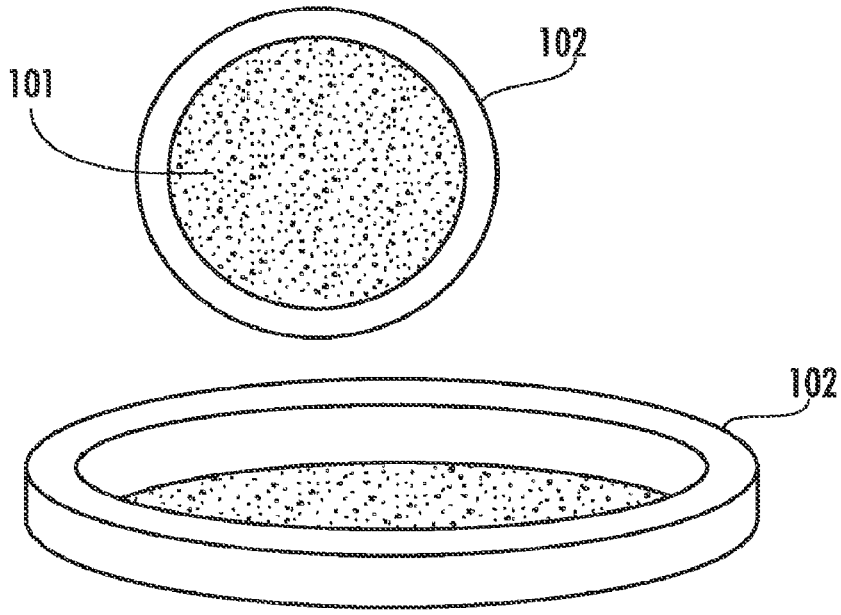
FIG. 10 is a diagram of a framed membrane in accordance with the embodiments of the invention.

FIG. 10 is a diagram of a framed membrane in accordance with another embodiment of the invention. The framed membrane can include the membrane 101 and a frame 102 having at least one aperture. The materials used for the containers can be paraffined cardboard, aluminum and cardboard complex, PVC, polyethylene high and low density, polypropylene, polyolefin, ethylene polyterephthalate, glass, metal, acid lactic polymers, polyacrylamides, polymethacrylates, and their derivatives. The stretched membrane which can be fixed on a rigid frame, allows several partition walls to be created among several cavities.

According to FIGS. 7 to 11, it is possible to insert the wall partition (e.g. framed membrane) inside a container by stretching the membrane on the frame, and gluing or clipping the two compartments of the container. The wall partition can be created during a filling process that fills the first container 111 with a first substance. In such regard, the partition wall can be generated during any kind of packaging, soft or rigid.

Figure 11:
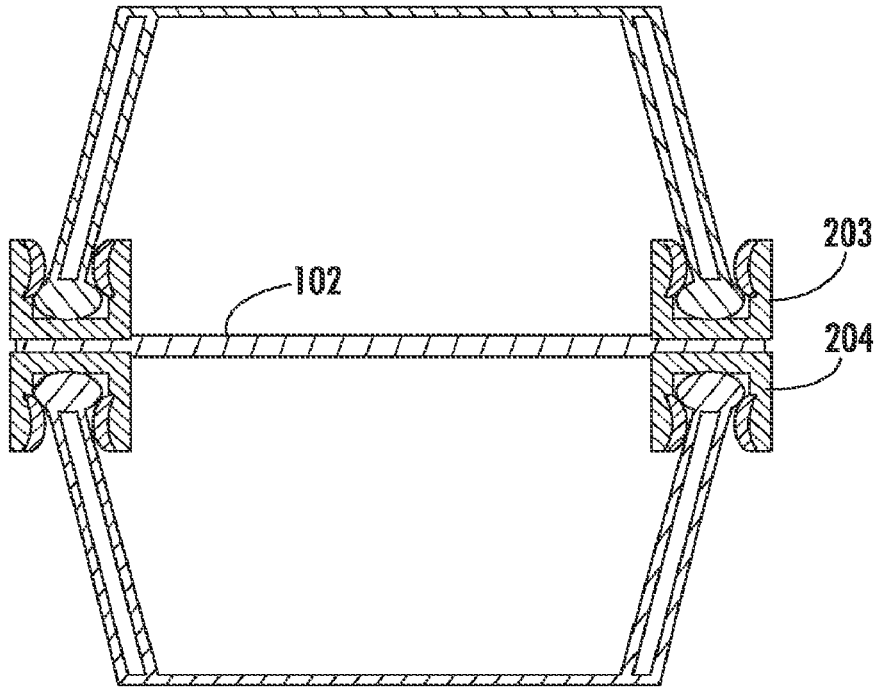
FIG. 11 depicts a framed membrane of a separation container in accordance with the embodiments of the invention.

FIG. 11 depicts a framed membrane of a separation container in accordance with one embodiment of the invention. As illustrated, the framed membrane includes a top aperture 203 and a bottom aperture 204.

Figure 12:
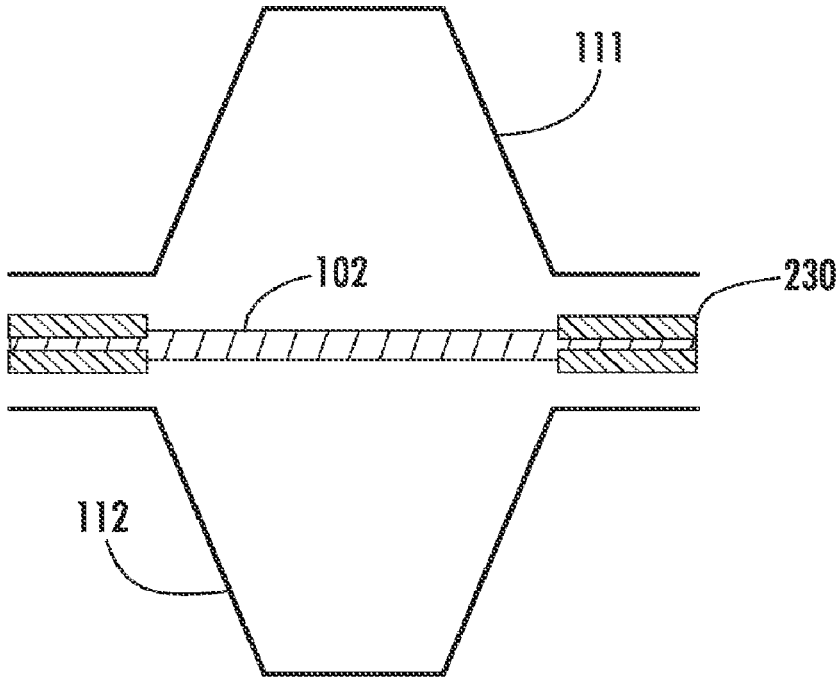
FIG. 12 depicts components of the frame of FIG. 9 for a separation container in accordance with the embodiments of the invention.

FIG. 12 depicts components of the frame of FIG. 9 for a separation container in accordance with one embodiment of the invention. The compressible material 230 on the periphery of the frame receives along a top portion the first container 111, and receives along the bottom portion the second container 112. The first container 111 and the second container 112 can be glued or affixed to the compressible material 230.

Figure 13:
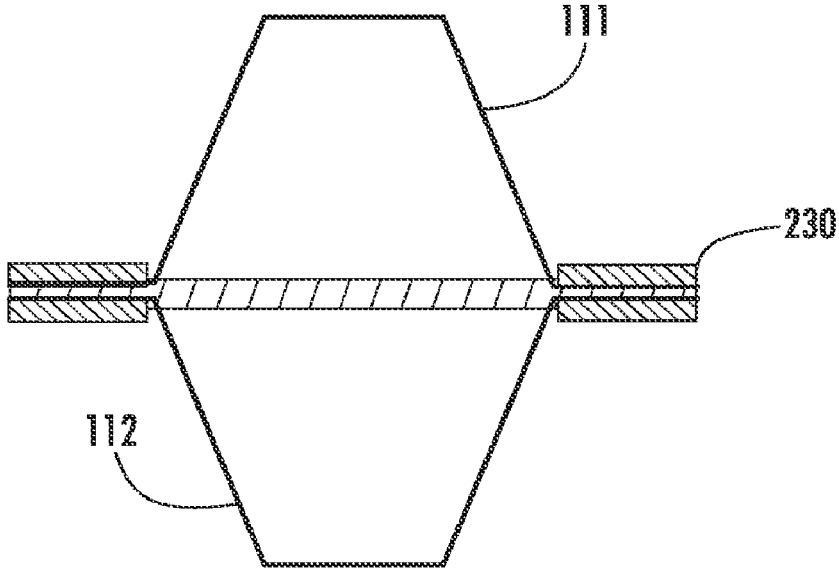
FIG. 13 depicts the separation container of FIG. 12 in a sealed configuration in accordance with the embodiments of the invention.

FIG. 13 depicts the separation container of FIG. 12 in a sealed configuration.

Briefly, FIGS. 14 to 21 illustrate various embodiments of the frame 102 which allow for an opening of separation container 110. The opening can be achieved by stretching (see FIG. 14), piercing (see FIG. 15-16), or pinching (see FIG. 20-21).

Figure 14:
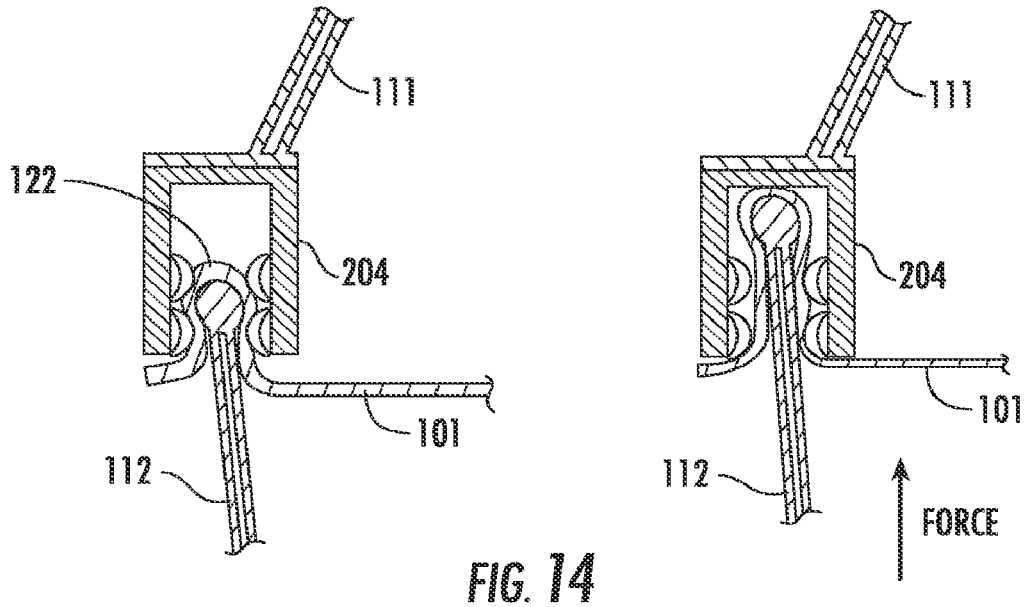
FIG. 14 is a zoomed in view of a rim inserted into a clipping system of a frame, and a stretching of the membrane to provide a tension seal due to the inserting of the rim in accordance with the embodiments of the invention.

FIG. 14 is a zoomed in view of a rim 122 inserted into a clipping system of an aperture 204, and a stretching of the membrane 102 to provide a tension seal due to the inserting of the rim 122 in the aperture 204 in accordance with the embodiments of the invention. As shown in the accompanying illustration, the rim 122 ruptures the elastic membrane 101 due to a shearing force on the elastic membrane 101 as the rim 122 is inserted into the aperture 204 responsive to the force applied to at least one of the first container 111 and the second container 112.

The clipping system securely receives a rim 122 of the container 112, and the elastic membrane 101 is interdisposed onto the rim 122 and held in place in the aperture 204 by the clipping system. The rim 122 ruptures the elastic membrane 101 due to a shearing, piercing, or tearing force on the elastic membrane 101 as the rim 122 is pushed into the aperture 204 of the frame responsive to the force applied to the first container and/or the second container.

Opening by stretching is based on the membrane being at its maximum of tension. A further increase due to stretching will cause rupture. In one embodiment, this can be achieved by the presence of a outside strip 231 (See FIG. 8) of the flexible membrane. This strip 231 is obtained by a special cut of the partition wall after its setting under tension next to the compartment or during the manufacturing of the partition wall frame. The stretch of this strip 231 leads to an increasing of the membrane tension inside the packaging until its breaking. This frame structure can be inserted "in process" next to the containers by gluing or thermo sealing.

In a second embodiment a double clipping (See FIG. 8) can be used for opening by stretching. A first clipping permits an overlap of the first container 111 and the second container 112 around the frame. The second container 112 can be clipped on the first container if the elastic membrane 101 is sealed onto the second container 112. The second clipping leads to an additional stretch of the elastic membrane 101 which is stuck in place either by clipping or glue and which induces the rupture. The frame structure for double clipping ensures some security during a filling process and transport. This helps an untimely opening due to pressure variations onto the membrane.

Figure 15:
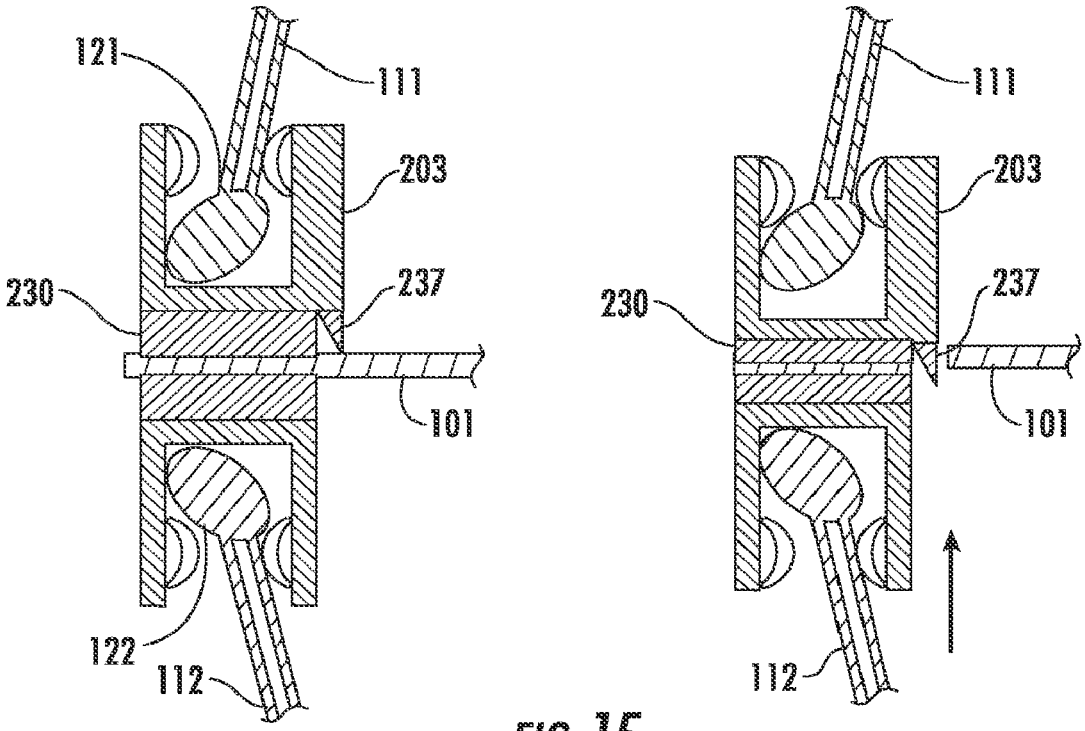
FIG. 15 is a zoomed in view of the frame of FIG. 9 showing a puncturing device attached to the frame, and a rupturing of the membrane due to a compression of the frame responsive to a force applied to the separation container in accordance with the embodiments of the invention.

FIG. 15 is a zoomed in view of the frame of FIG. 9 showing a puncturing device 237 attached to the aperture 203 of the frame, and a rupturing of the membrane 101 due to a compression of the frame responsive to a force applied to the separation container. As illustrated, at least one compressible material 230 is interdisposed between the first rim 121 of the first cavity 111 and a second rim 122 of the second cavity 112 such that the compressible material 230 provides the tension seal of the elastic membrane. The puncturing device is coupled to the frame and ruptures the elastic membrane 101 responsive to a force applied to the first container and the second container. As shown in the accompanying illustration, the compressible material 230 compresses in size during the force to cause the puncturing device 237 to pierce, shear, or tear the elastic membrane 101.

In this arrangement, a top portion has a top aperture 203 to receive a first rim 121 of the first container 111, and a bottom portion has a bottom aperture 204 to receive a second rim 122 of the second container 112. The compressible material is interdisposed between the top portion and the bottom portion to provide the tension seal of the elastic membrane 101. The puncturing device can be coupled to either the top portion or bottom portion to ruptures the elastic membrane responsive to the force.

Opening by piercing is obtained by a special design of the frame of the partition wall or of the edge of one of the compartments (e.g. containers) which include the presence of the sharp punch 237 interdependent of the frame or of the compartment and obtained by molding. The elastic membrane 101 is fixed on the frame 102, the one of FIG. 15 is molded in such form that the sharp punch 237 is inside, the sharp part of it turned to the membrane 101. The compressible material 230 is inserted between the frame (e.g. aperture 203) and the elastic membrane 101 to prevent rupture of the elastic membrane 101. The height of the compressible material 230 is such that the sharp part is not in contact with the membrane in a default position. A simple pressure on the upper compartment can be applied to induce the opening of the elastic membrane 101 within the separation container 110. The compressible material 230, also considered a flexible joint, can operate similar to a spring that becomes flat under the pressure, and which causes the sharp part of the punch to pierce the elastic membrane 101.

Figure 16:
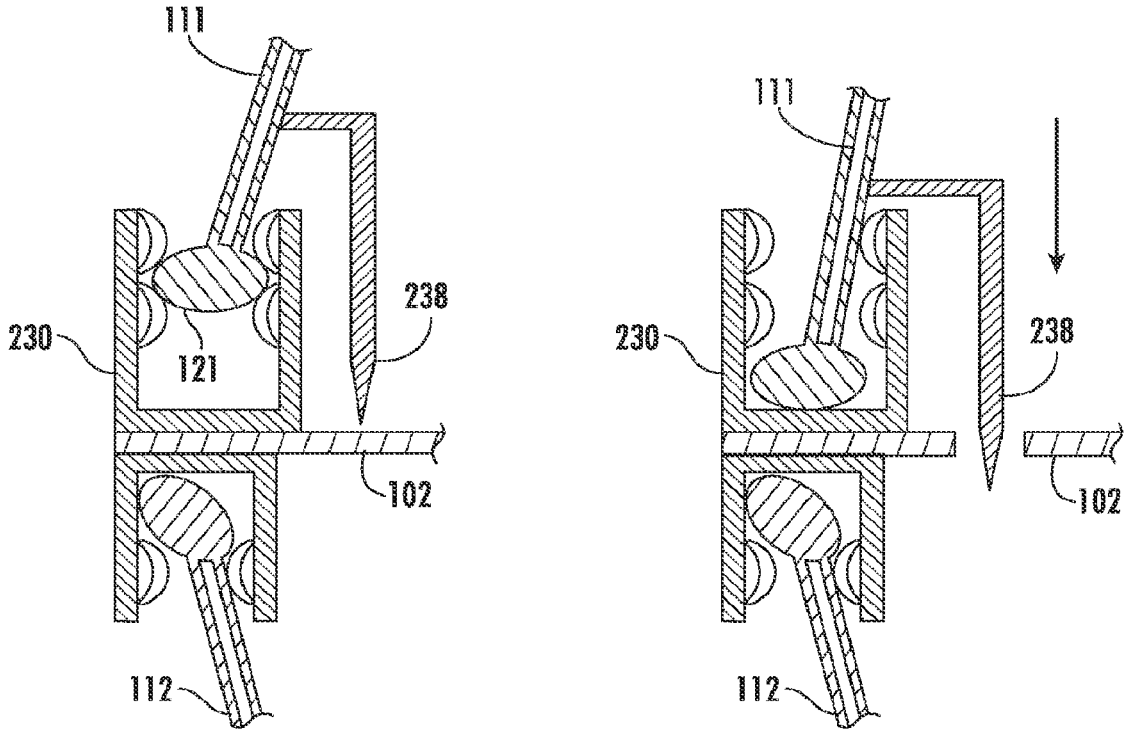
FIG. 16 is a zoomed in view of a frame showing a puncturing device attached to a container, and a rupturing of the membrane due to the puncturing device responsive to a force applied to the separation container in accordance with the embodiments of the invention.

FIG. 16 is a zoomed in view of a frame showing a puncturing device 238 attached to the first container 111, and a rupturing of the membrane 101 due to the puncturing device 238 responsive to a force applied to the separation container. In this arrangement, the sharp punch 238 is molded onto the edge of the container 111 and the frame carrying the membrane possesses an opening on the flat part in contact with the elastic membrane 101, on each side of the frame, or across the periphery. The puncturing device 238 pierces the elastic membrane responsive to an applied force.

Figure 17:
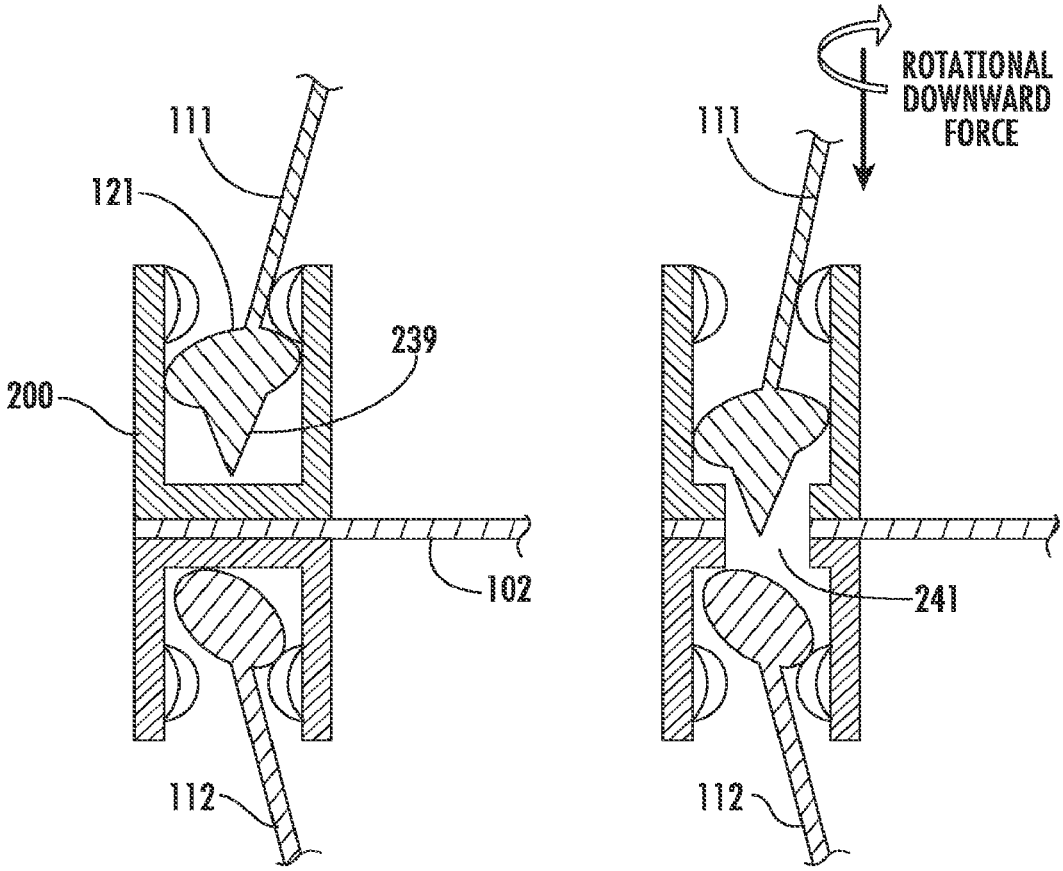
FIG. 17 is a zoomed in view of a frame showing a puncturing device on a rim of a container, and a rupturing of the membrane due to the puncturing device responsive to a force applied to the separation container in accordance with the embodiments of the invention.

FIG. 17 is a zoomed in view of a frame showing a puncturing device 239 on a rim 121 of a container 111, and a rupturing of the membrane 101 due to the puncturing device 239 responsive to a force applied to the separation container. As illustrated, the puncturing device 239 is internal to an aperture of the frame, though it can be external to the device, and hidden. The tension seal ruptures around the periphery responsive to the force applied to at least one of the first container and the second container. It should also be noted that the membrane can completely retract within the frame upon rupture, such that the opening of the first container 111 is completely exposed to the opening of the second container 112. This allows for all the contents in the first container 111 to completely mix with the contents in the second container 112. The structure of the frame, including the apertures, allows for the membrane to be retracted into the apertures thereby exposing the first opening to the second opening.

The height of the puncturing device 239 is greater than the thickness of the aperture 203. The compartment clipping on the partition wall frame is realized in such manner as the puncturing device 239 is in contact of the continuous flat part of the frame. This arrangement also prevents untimely rupture of the elastic membrane 101. By moving the first container 111 in the frame of the partition wall, the sharp punch 239 is guided in the aperture of the flat part of the frame. Due to the fact that this sharp part is longer than the thickness of the flat part of the frame, puncturing device 239 pierces the membrane within the aperture 203, which causes the elastic membrane 101 to rupture and retract to frame, thus providing an opening for a complete flow of the substance contained in the upper cavity. More specifically, the space between the wall of the compartment and the puncturing device 239 can be at least equal to the half of the width of the frame on which the flexible membrane is fixed. The height can exceed at least 10% of the frame height at this location to allow the puncturing device 239 to pierce the membrane, at the time for the utilization of the packaging.

Figure 18:
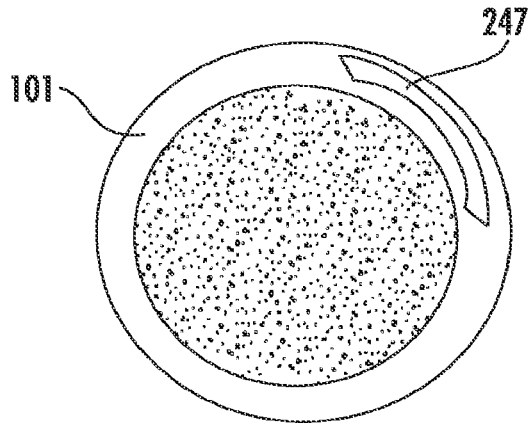
FIG. 18 illustrates a rupturing of the membrane along the frame responsive to a force applied to the separation container in accordance with the embodiments of the invention.

FIG. 18 illustrates a partial rupturing of the membrane 101 along the frame responsive to a force applied to the separation container in accordance with the embodiments of the invention. Notably, the rupturing 247 of the membrane can be considered complete when either the entire membrane 101 is fully retracted into the apertures of the frame, of the membrane is perforated to completely reveal the opening between the first container and the second container.

Figure 19:
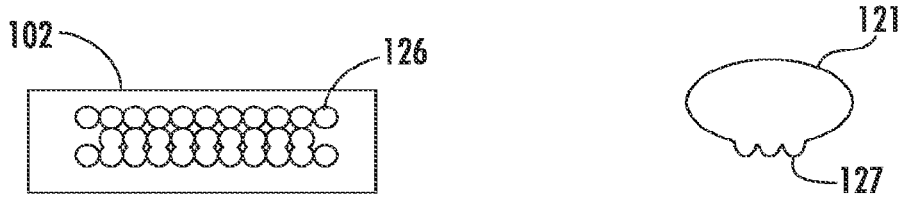
FIG. 19 illustrates a lug surface of the frame, and one or more lugs on a rim of a container in accordance with the embodiments of the invention.

FIG. 19 illustrates a lug surface 126 of the frame 102, and one or more lugs 127 on a rim 121 of a container in accordance with one embodiment of the invention. The rim 121 pinches the membrane along the rough zone along the lug surface of the frame responsive to a compressing or rotational force that causes the elastic membrane to rupture within the frame. The lug surface provides traction for receiving the user applied force, which can cause a stretch or a pressure tear of the elastic membrane when interdisposed between the frame 102 and rim 121.

Figure 20:
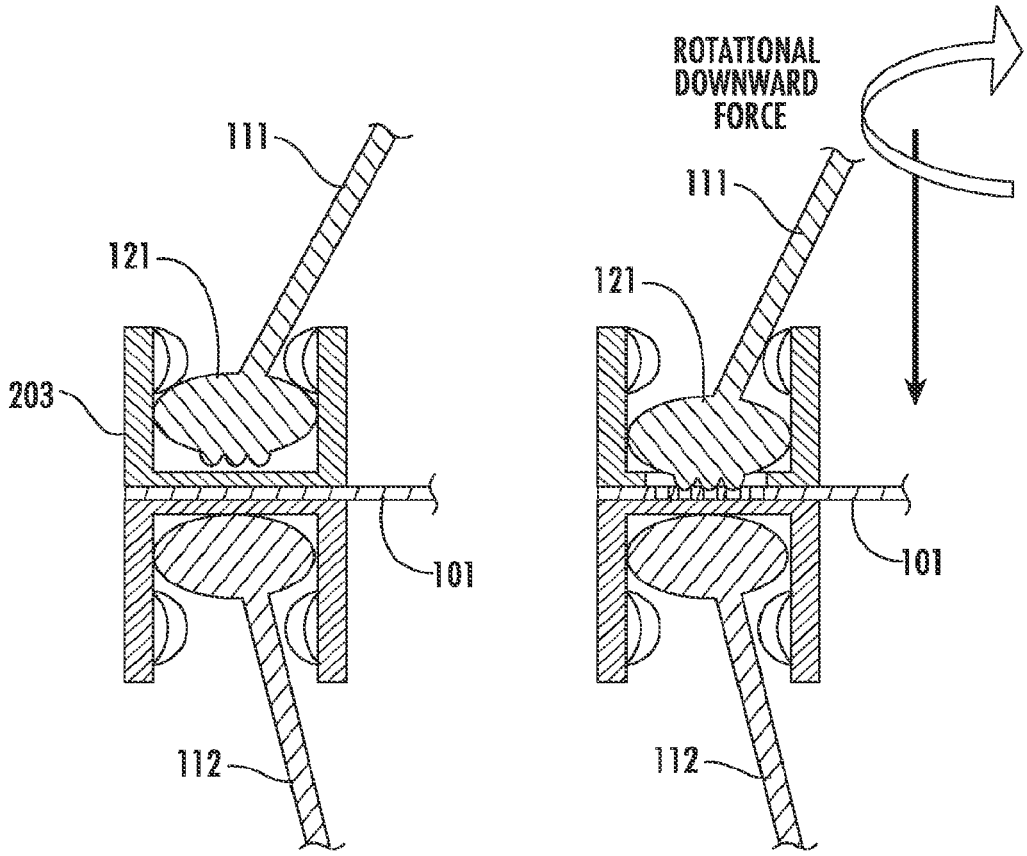
FIG. 20 illustrates a rupturing of the membrane responsive to a rotational force of the separation container that causes the one or more lugs of the rim to pinch and rub the membrane against the lugs of the frame in accordance with the embodiments of the invention.

FIG. 20 illustrates a rupturing of the membrane 101 responsive to a rotational force of the separation container that causes the one or more lugs 127 of the rim 121 to pinch and rub the membrane 101 against the lug surface 126 of the frame. In this configuration, the first container 111 includes the first rim 121 having an edge surface with lugs that are located internal to the aperture 203 of the frame, wherein the lugs 127 rub across the elastic membrane 101 responsive to a rotational movement of the first container relative to the second container to cause the elastic membrane 101 to rupture the tension seal around the periphery and cause the first substance of the first container to combine with the second substance of the second container. In this arrangement, the aperture 203 located along the periphery of the frame includes a frictional surface that causes the elastic membrane 101 to rupture along the periphery responsive to a rotational force of the first container and the second container.

As a result of the rough surface 126 of the frame 102 and the one or more lugs 127 of the rim 121, a frictional threshold is generated for pinching. In order to rupture the tension seal of the elastic membrane, the user must apply sufficient rotational and/or downward force to exceed the frictional threshold. The tension of the elastic material stretches responsive to the applied force and increases until its maximum resistance is achieved which induces the rupture of the elastic membrane. The rotation of the containers leads to the pinching of the membrane between the lugs and the frame. By continuing the rotation the pinching increases and the tension of the membrane increases until the elastic membrane 101 tears or rips. The pinching can be obtained either by stretching of the membrane affixed between the surface of the frame and the rough part of the edge of the compartment due to turning or twisting of the first container, or by stretching of the affixed membrane between the rough surfaces of each container (e.g. along a rim or aperture) through a perforation made on sides of the frame, due to rotation of the first container in an opposite direction of the second container.

Figure 21:
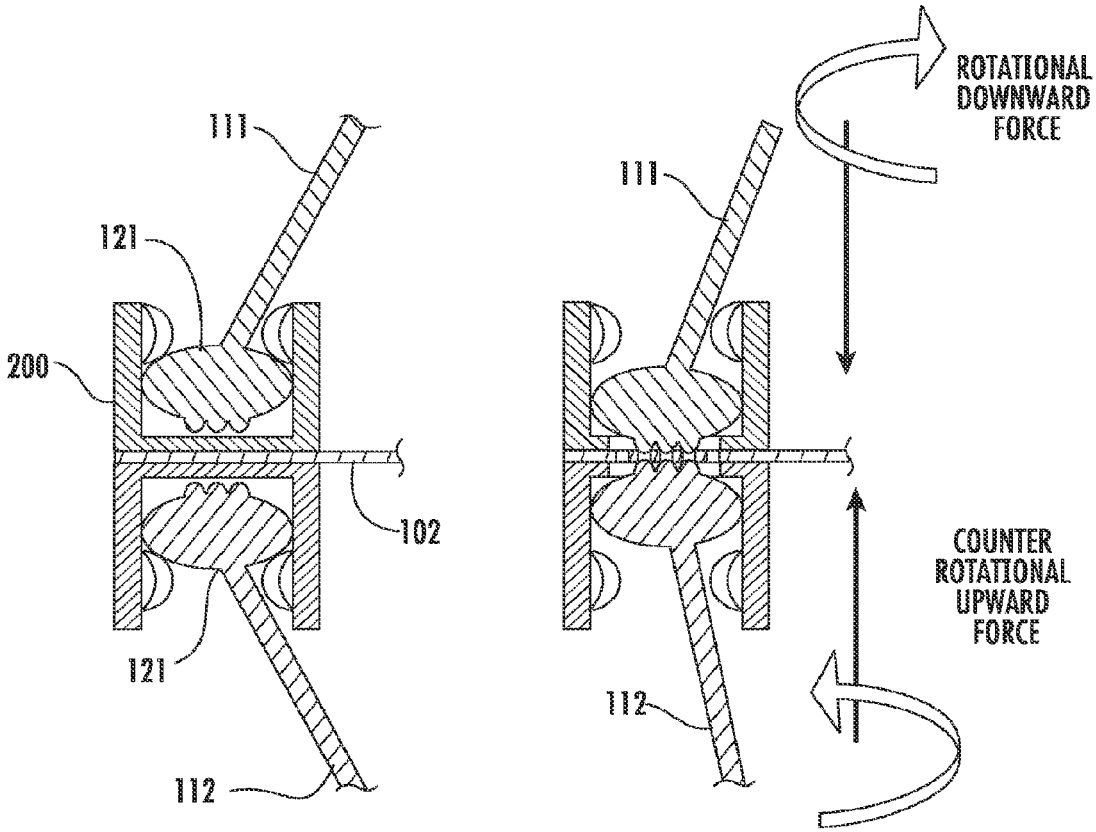
FIG. 21 illustrates one or more lugs on a first rim and one or more lugs on a second rim for rupturing the membrane responsive to a rotational force of the separation container that causes the one or more lugs of the first rim to pinch and rub the membrane against the one or more lugs of the second rim in accordance with the embodiments of the invention.

FIG. 21 illustrates one or more lugs on a first rim and one or more lugs on a second rim for rupturing the membrane responsive to a rotational force of the separation container that causes the one or more lugs of the first rim to pinch and rub the membrane against the one or more lugs of the second rim in accordance with the embodiments of the invention.

While the preferred embodiments of the invention have been illustrated and described, it will be clear that the embodiments of the invention is not so limited. Numerous modifications, changes, variations, substitutions and equivalents will occur to those skilled in the art without departing from the spirit and scope of the present embodiments of the invention as defined by the appended claims.

What is claimed is:

1. A separation container, comprising:

a first container having a first cavity suitable for storing a first substance;

a second container having a second cavity suitable for storing a second substance; and a frame structurally located at a periphery of the first cavity and a periphery of the second cavity, the frame supporting an elastic membrane interdisposed between the first cavity and the second cavity and providing a tension seal to separate the first substance from the second substance, wherein the elastic membrane is stretched across at least one of the periphery of the first cavity and the periphery of the second cavity and held in place by the frame to provide the tension seal, wherein the elastic membrane is totally retracted to allow the first substance to combine with the second substance responsive to a force applied to at least one of the first container and the second container that causes the frame to rupture the tension seal along the periphery.

2. The separation container of claim 1, wherein the frame includes at least one clip in an aperture of the frame that receives a rim of the first container, wherein the elastic membrane is interdisposed onto the rim and held in place to provide the tension seal, and the rim ruptures the elastic membrane due to a shearing force on the elastic membrane as the rim is inserted into the aperture responsive to the force applied to at least one of the first container and the second container.

3. The separation container of claim 2, wherein the frame includes at least one clip in a second aperture of the frame that receives a rim of the second container to stabilize the separation during an applying of the force.

4. The separation container of claim 1, wherein the frame includes at least one compressible material interdisposed between a first rim of the first cavity and a second rim of the second cavity such that the compressible material provides the tension seal of the elastic membrane; and a puncturing device coupled to the frame configured to pierce, shear, or tear the elastic membrane.

5. The separation container of claim 1, further comprising a puncturing device attached to at least one of the periphery of the first container and the periphery the second container, and wherein the puncturing device ruptures the tension seal around the periphery responsive to the force applied to at least one of the first container and the second container.

6. The separation container of claim 1, wherein the first container includes a puncturing device along a first rim of the first container, wherein the puncturing device is internal to an aperture of the frame and ruptures the tension seal around the periphery responsive to the force applied to at least one of the first container and the second container.

7. The separation container of claim 1, wherein the first container includes a first rim having an edge surface with lugs that are located internal to an aperture of the frame, wherein the lugs rub across the elastic membrane responsive to a rotational movement of the first container relative to the second container to cause the elastic membrane to rupture the tension seal around the periphery and cause the first substance to combine with the second substance.

8. A frame suitable for partitioning a first container and a second container, the frame comprising:

at least one aperture located along a periphery of the frame;

at least one clip inserted in the at least one aperture to form a clipping system that firmly holds at least one of a rim of the first container and a rim of the second container; and an elastic membrane stretched across the frame and held in place by clipping or glue to produce a tension seal that separates a first substance in the first container from a second substance in the second container, wherein the elastic membrane is totally retracted to allow the first substance in the first container to combine with the second substance of the second container responsive to a force applied to at least one of the first container and the second container that causes the frame to rupture the tension seal along the periphery.

9. The frame of claim 8, wherein the clipping system securely receives a first rim of the first container, and the elastic membrane is interdisposed onto the first rim and held in place in the aperture by the clipping system, wherein the first rim ruptures the elastic membrane due to a shearing, piercing, or tearing force on the elastic membrane as the first rim is pushed into the aperture of the frame responsive to the force applied to at least one of the first container and the second container.

10. The frame of claim 8, further comprising a puncturing device attached to the frame, the puncturing device puncturing the elastic membrane.

11. The frame of claim 8, wherein the clipping system pinches the membrane along a rough zone of the frame responsive to a compressing or rotational force that causes the elastic membrane to rupture.

12. The frame of claim 8, wherein the frame includes a double clipping mechanism having an outside strip that firmly holds the elastic membrane and an inside strip that allows stretching and elongation of the elastic membrane along a rim of the first container to cause the elastic membrane to rupture.

13. The frame of claim 8, wherein the at least one aperture located along the periphery of the frame includes a frictional surface that causes the elastic membrane to rupture along the periphery responsive to a rotational force of at least one of the first container and the second container.

14. The frame of claim 8, further comprising:

a top portion with a top aperture to receive a first rim of a first container;

a bottom portion with a bottom aperture to receive a second rim of a second container;

a compressible material interdisposed between the top portion and the bottom portion and that provides the tension seal of the elastic membrane; and a puncturing device coupled to either the top portion or bottom portion that ruptures the elastic membrane, wherein the compressible material compresses in size during the force to cause the puncturing device to pierce, shear, or tear the elastic membrane and cause the rupture.

15. A separation container comprising:

a first container having a first cavity suitable for storing a first substance;

a second container having a second cavity suitable for storing a second substance;

a frame structurally formed around at least one of a periphery of the first cavity and a periphery of the second cavity, wherein the frame has an aperture for receiving a first rim of the first container and a second rim of the second container; and an elastic membrane interdisposed between the first cavity and the second cavity for providing a tension seal to separate the first substance from the second substance, wherein the elastic membrane is stretched across at least one of the periphery of the first cavity and the periphery of the second cavity and held in place by the frame to provide the tension seal, wherein the first rim has an edge surface with lugs that are located internal to the aperture of the frame, wherein the lugs rub across the elastic membrane responsive to a rotational movement of the first container relative to the second container to cause the elastic membrane to rupture the tension seal around the periphery to combine the first substance with the second substance.

16. The separation container of claim 15, wherein the second rim has a second edge surface with second lugs that are located internal to the aperture of the frame, wherein the second lugs rub across the elastic membrane and the lugs of the first rim responsive to a rotational movement of the first container relative to the second container to cause the elastic membrane to rupture the tension seal around the periphery to combine the first substance with the second substance.

17. The separation container of claim 15, wherein the elastic membrane comprises at least one of natural and synthetic polymers.

18. The separation container of claim 15, wherein the elastic membrane is at least one among the group of latex, synthetic polyisoprene, silicone polymers, chloropropene polymers, and polymers coming from the combination of acrylonitrile, butadiene, and carboxylic acid.

19. The separation container of claim 15, wherein the elastic membrane is directly fixed under tension between the first container and the second container by glue or clipping, and includes a perforation along which the elastic membrane ruptures responsive to the force.

20. The separation container of claim 15, wherein the aperture comprises at least one among the group of paraffined cardboard, aluminum and cardboard complex, PVC, polyolefin, ethylene polyterephthalate, glass, metal, acid lactic polymers, polyacrylamides, polymethacrylates, and derivatives therefrom.

21. The separation container of claim 15, wherein the elastic membrane comprises flexible meshes and having a thickness between 1 μm and 1000 μm.

22. The separation container of claim 21, wherein the elastic membrane has a maximal elongation modulus comprised between 50 and 1500.

23. The separation container of claim 22, wherein the elastic membrane is fixed between the two containers under elongation comprised between 70% and 100% of the maximal elongation modulus value.

* * * * *